US006694657B2

(12) United States Patent
Tsao

(10) Patent No.: US 6,694,657 B2
(45) Date of Patent: Feb. 24, 2004

(54) PICTURE FRAME HAVING FUNCTION OF POSTAL CARD

(76) Inventor: Chung-Piao Tsao, 4F, No. 22, Lane 346, Kuang-Fu S. Road, Taipei (TW)

( * ) Notice: Subject to any disclaimer, the term of this patent is extended or adjusted under 35 U.S.C. 154(b) by 0 days.

(21) Appl. No.: 10/132,937

(22) Filed: Apr. 24, 2002

(65) Prior Publication Data

US 2003/0200691 A1 Oct. 30, 2003

(51) Int. Cl.[7] ..... A47G 1/06

(52) U.S. Cl. ..... 40/789; 40/750; 40/754; 40/765; 40/774; 40/776; 229/71; 229/92.8

(58) Field of Search ..... 40/788, 789, 747, 40/748, 750, 751, 754, 765, 774, 776, 786; 229/71, 92.8

(56) References Cited

U.S. PATENT DOCUMENTS 1,164,805 A * 12/1915 Gibbs ..... 229/92.8
1,347,269 A * 7/1920 Greble ..... 40/750
1,421,097 A * 6/1922 Pente ..... 40/754
1,515,901 A * 11/1924 Helmquest ..... 40/124.09
1,539,619 A * 5/1925 Wood ..... 40/778
2,443,645 A * 6/1948 Turan ..... 40/750
2,991,578 A * 7/1961 Messina ..... 40/750
3,420,432 A * 1/1969 Cooper ..... 229/71
3,875,693 A * 4/1975 Pelkey ..... 40/776
4,244,511 A * 1/1981 Coleman ..... 40/774
5,678,756 A * 10/1997 Sugiura ..... 229/92.8

* cited by examiner

*Primary Examiner*—Gary Hoge

(57) ABSTRACT

A picture frame includes a picture holder for mounting a picture or photograph on the holder and two folding members hingedly formed on opposite sides of the holder; whereby upon backward folding of the two folding members, the picture frame will be supported and erected for displaying the picture; and upon a forward folding of the two folding members to cover the picture frame, it may serve as a "postal card" ready for postal mailing.

4 Claims, 4 Drawing Sheets

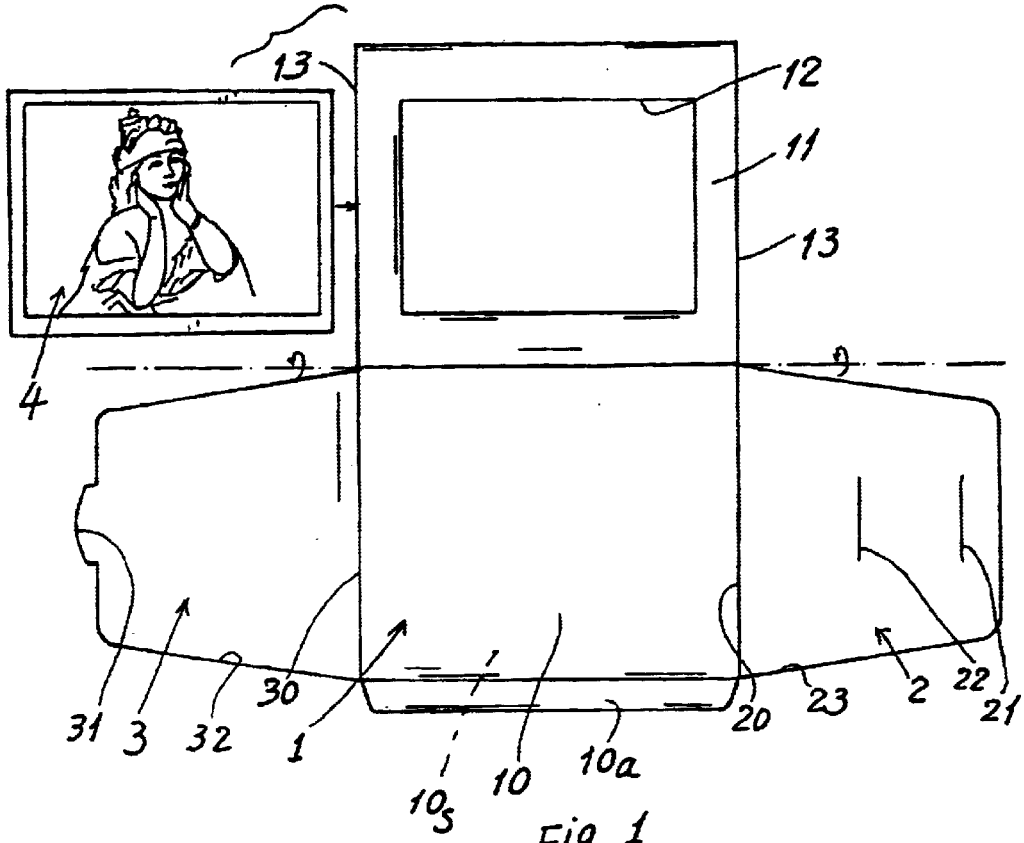
Fig. 1
Fig. 2
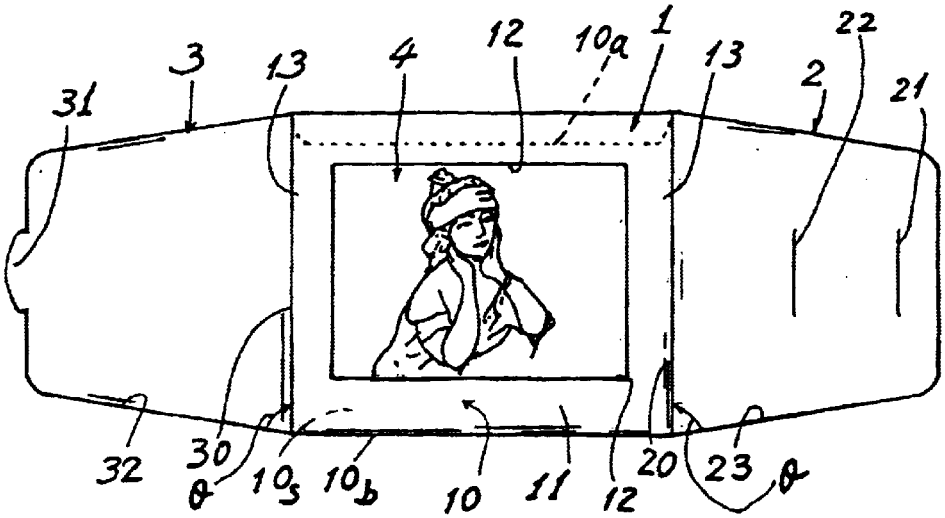

PICTURE FRAME HAVING FUNCTION OF POSTAL CARD

BACKGROUND OF THE INVENTION

Whenever taking a picture from a scenery, the picture must be filled in an envelope for postal mailing. If the picture is provided for display purpose in a room, the picture should be embedded in a picture frame which requires inconvenient procedures for mounting the picture in the frame.

The present inventor has found these phenomena and invented the present article playing double duties both for picture frame and also for postal card for display and mailing.

SUMMARY OF THE INVENTION

The object of the present invention is to provide a picture frame including a picture holder for mounting a picture or photograph on the holder and two folding members hingedly formed on opposite sides of the holder; whereby upon backward folding of the two folding members, the picture frame will be supported and erected for displaying the picture; and upon a forward folding of the two folding members to cover the picture frame, it may serve as a "postal card" ready for postal mailing.

BRIEF DESCRIPTION OF THE DRAWINGS

FIG. 1 is an exploded view of the present invention.

FIG. 2 is an illustration showing the insertion of a picture into the picture holder of the present invention.

DETAILED DESCRIPTION

Figure 3:
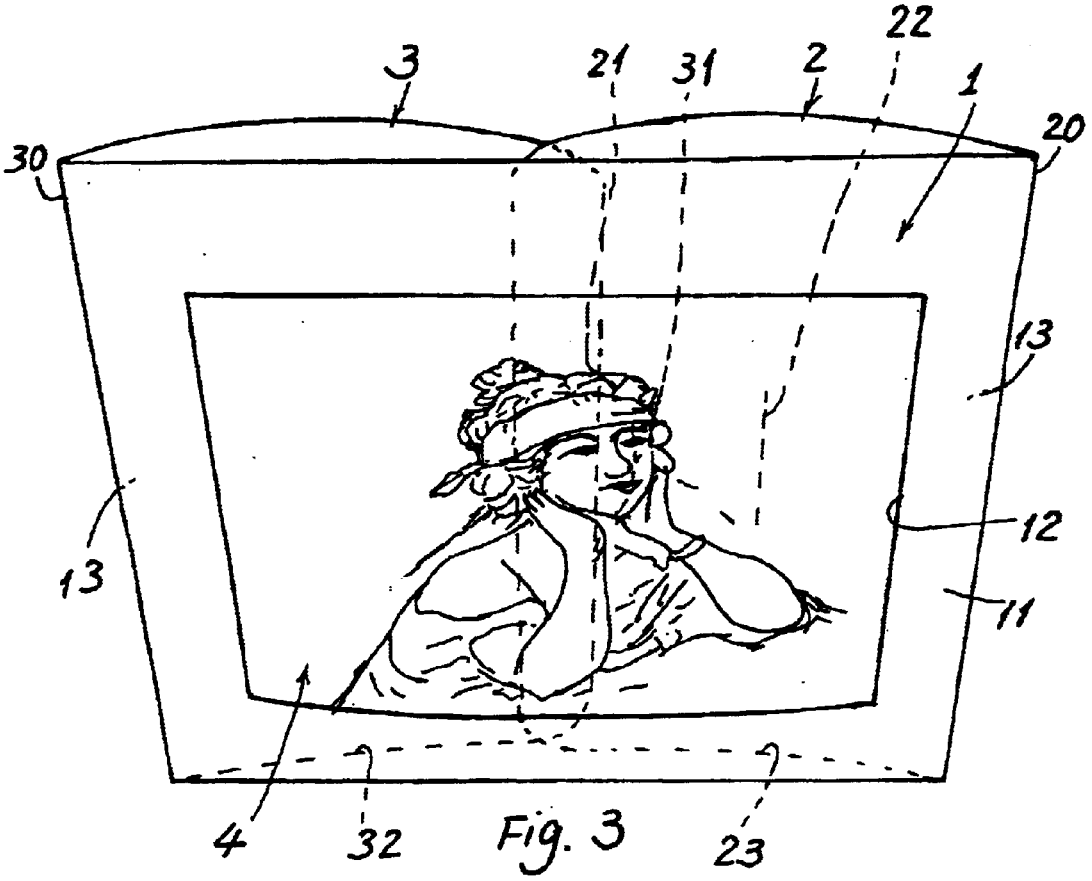
FIG. 3 shows a picture frame when backward folding the two folding members formed on the picture holder for supporting the frame.

As shown in FIGS. 1–6, the present invention comprises: a picture holder 1, a first folding member 2 and a second folding member 3 respectively formed on opposite sides of the picture holder 1, having a picture or photograph 4 inserted, embedded or fixed in the picture holder 1.

All elements of the present invention may be made of paper, paperboard or other suitable materials, not limited in the present invention. The two folding members 2, 3 may be interlocked by any locking mechanism, also not limited in this invention.

Figure 6:
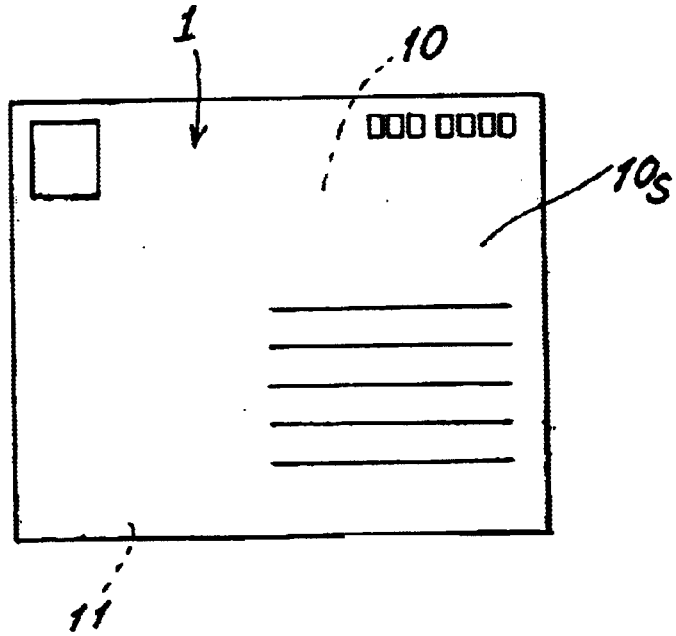
FIG. 6 is a rear view of the present invention as shown in FIG. 5.

The picture holder 1 is formed as a rectangular shape or any other shapes, not limited in the present invention. The picture holder 1 includes: a basic board (or sheet) 10 having the first folding member 2 and the second folding member 3 hingedly formed on a first and a second side of the basic board 10, a framing member 11 superimposed on the basic board 10 and hingedly formed on a third side of the basic board 10 and adhered or fastened to a fourth side of the basic board 10 (by adhesive) with a flap 10*a* formed on a fourth side of the basic board 10, a display window 12 formed in the framing member 11 for displaying the picture or photograph 4 as inserted in the picture holder 1, a pair of slots 13 respectively formed on opposite sides of the picture holder 1 each slot 13 defined in between the framing member 11 and the basic board 10 for inserting the picture 4 into the picture holder 1 through the slot 13, and a printing surface 10*s* formed on a back side of the basic board 10 for writing or printing the addressee's name and address and the sender's name and address on the printing surface 10*s* for postal mailing (FIG. 6).

The first folding member 2 is hingedly formed on a first side of the basic board 10 of the picture holder 1 about a first folding line 20 and having a first engaging hole 21 formed in an outer portion of the first folding member 2, a second engaging hole 22 formed in an inner portion of the first folding member 2 adjacent to the first holding line 20, each engaging hole 21 or 22 engaging with an engaging latch 31 formed on the second folding member 3, and having a first bottom edge 23 formed on a bottom of the first folding member 2 to be inclinedly intersected with a bottom edge 10*b* of the basic board 10 of the picture holder 1 with an acute angle θ approximating 90 degrees.

Naturally, the bottom edge 23 of the first folding member 2 may also be coplanar to the bottom edge 10*b* of the basic board 10 of the picture holder 1 (indicating the variation of acute angle to be a right angle).

The engaging hole 21 or 22 of the first member 2 may also be defined as a "female connector" corresponding to the engaging latch 31, which may also be defined as a "male connector", of the second member 3.

The second folding member 3 is hingedly formed on a second side of the basic board 10 of the picture holder 1 about a second folding line 30 and having an engaging latch 31 formed on an outer portion of the second folding member 3 to be engaged with either the first engaging hole 21 or the second engaging hole 22 of the first folding member 2, and having a second bottom edge 32 formed on a bottom of the second folding member 3 to be inclinedly intersected with the bottom edge 10*b* of the basic board 10 of the picture holder 1 with an acute angle θ approximating 90 degrees.

The bottom edge 32 may also be coplanar to the bottom edge 10*b* of the basic board 10. It means that the acute angle now becomes 90 degrees.

Figure 4:
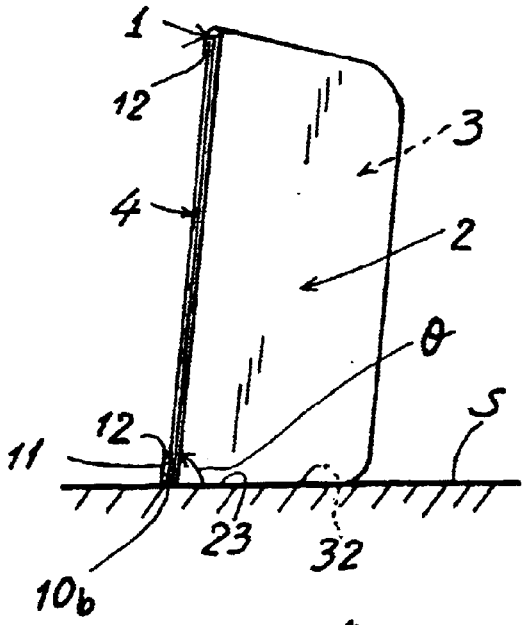
FIG. 4 is a side view of FIG. 3.

Upon interlocking the first and second folding members 2, 3 by engaging the first engaging hole 21 with the engaging latch 31 when backward folding the first and second folding members 2, 3, the two folding members 2, 3 as interlocked each other as shown in FIGS. 3, 4 will serve as a supporting stand for supporting and erecting the picture frame 1 for displaying the picture or photograph 4 as embedded in the holder 1.

Figure 5:
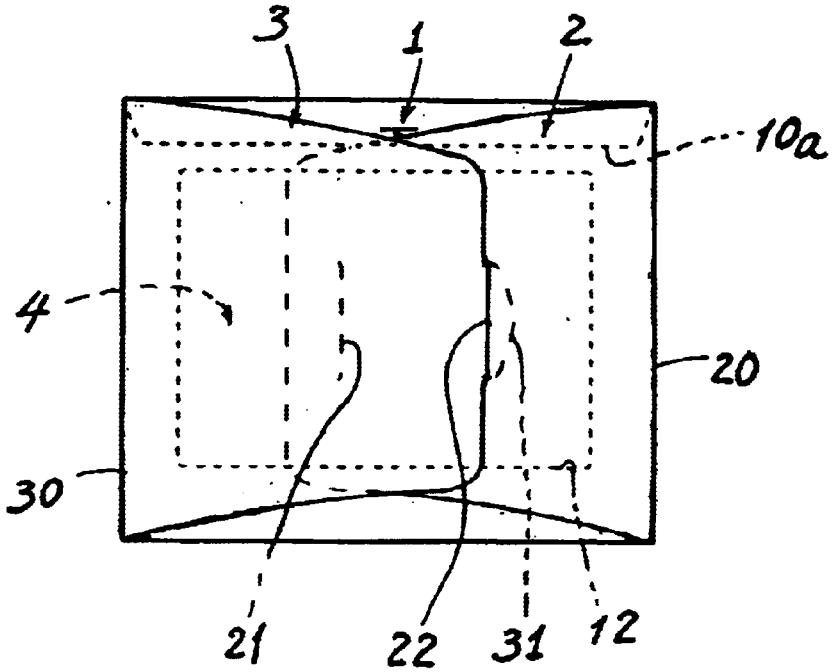
FIG. 5 is an illustration when covering the two folding members on the picture frame.

While engaging the engaging latch 31 of the second folding member 3 with the second engaging hole 22 of the first folding member 2 as shown in FIG. 5, the two folding members 2, 3 will be flatly locked to cover the picture 4 as shown in FIG. 5, and the printing surface 10*s* on the back (reverse) side of the picture holder 1 will be presented for printing or writing use for a postal card.

For ensuring a safe closing of the two folding members 2, 3, an adhesive tape may be applied to adhere the two members 2, 3 to prevent from opening of the folding members 2, 3 for a reliable mailing of the "postal card" of the present invention.

The present invention plays double roles both for serving as a picture frame and also as a postal card ready for mailing. Just by varying the engagement positions of the two folding members 2, 3 before (on) the picture 4 (FIG. 5) or after the picture 4 (FIG. 3), the present invention may be conveniently used either for mailing or for display.

Figure 7:
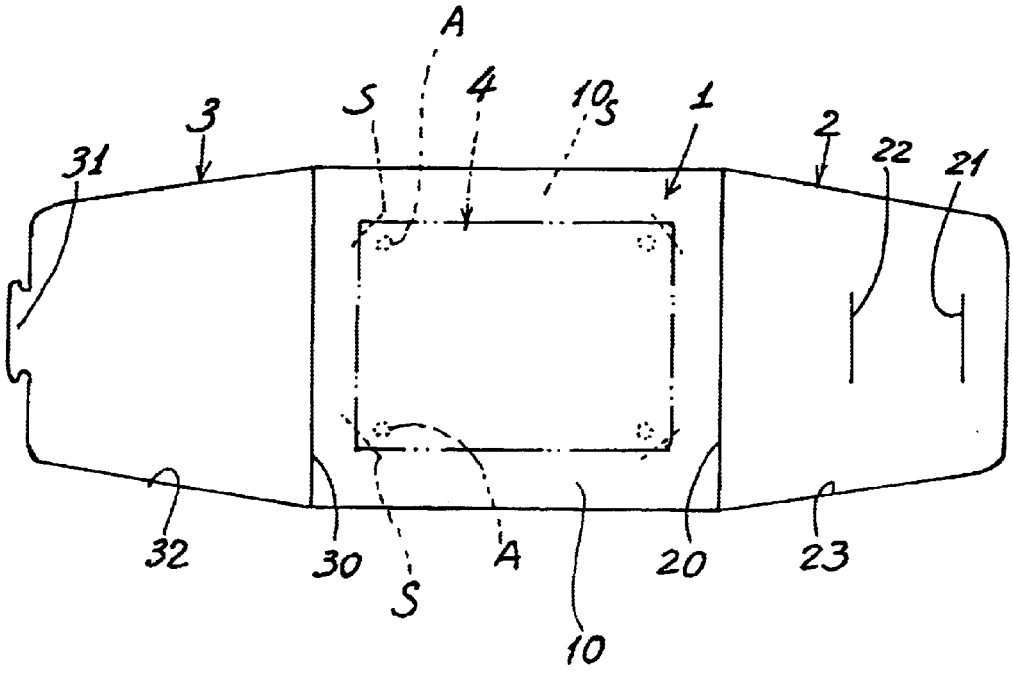
FIG. 7 shows another preferred embodiment of the present invention.

As shown in FIG. 7, the picture holder 1 may be modified to eliminate the framing member 11 as shown in FIG. 1. The picture or photograph 4 may then be directly adhered on the basic board 10 as shown in dotted line of numerals A. Also, the basic board 10 may be cut with four or plural slits S for embedding the picture 4 into the slits S for mounting the picture directly on the picture holder 1 for display purpose.

The present invention may be modified without departing from the spirit and scope of the present invention. The picture holder 1 should be made as thin as possible to "simulate" the real postal card for convenient mailing.

I claim:

1. A picture frame having function of postal card, comprising:

a thin picture holder adapted for mounting a picture or photograph on said picture holder, said picture holder including:

a basic board having a first folding member and a second folding member hingedly formed on a first and a second side of the basic board, a framing member superimposed on the basic board and hingedly formed on a third side of the basic board and fastened to a fourth side of the basic board with a flap formed on a fourth side of the basic board, a display window formed in the framing member for displaying the picture as inserted in the picture holder, a pair of slots respectively formed on opposite sides of the picture holder each said slot defined in between the framing member and the basic board for inserting the picture into the picture holder through the slot, and a printing surface formed on a back side of the basic board for writing or printing;

whereby upon engagement of said first and second folding members by backward folding said two folding members behind said picture holder, said picture holder will be supported and erected by said two folding members as backward engaged;

and upon forward folding of said two folding members to be flatly engaged in front of said picture holder for covering said picture in said picture holder, the picture holder as covered by said two folding members will be served as a postal card for mailing.

2. A picture frame according to claim 1, wherein said first folding member is hingedly formed on a first side of the basic board of the picture holder about a first folding line and having a first engaging hole formed in an outer portion of the first folding member, a second engaging hole formed in an inner portion of the first folding member adjacent to the first holding line, each said engaging hole engaging with an engaging latch formed on the second folding member, and having a first bottom edge formed on a bottom of the first folding member to be intersected with a bottom edge of the basic board of the picture holder with an angle selected from an acute angle and a right angle.

3. A picture frame according to claim 2, wherein said second folding member is hingedly formed on a second side of the basic board of the picture holder about a second folding line and having said engaging latch formed on an outer portion of the second folding member to be engaged with one said engaging hole as selected from the first engaging hole and the second engaging hole of the first folding member, and having a second bottom edge formed on a bottom of the second folding member to be intersected with the bottom edge of the basic board of the picture holder with an angle selected from an acute angle and a right angle.

4. A picture frame according to claim 1, wherein said basic board has said picture directly adhered thereon with adhesive.

* * * * *